US007999182B2

(12) United States Patent
Lallouet et al.

(10) Patent No.: US 7,999,182 B2
(45) Date of Patent: Aug. 16, 2011

(54) DEVICE FOR CONNECTING TWO SUPERCONDUCTIVE CABLES

(75) Inventors: Nicolas Lallouet, Fiennes (FR); Sébastien Delplace, Loon-Plage (FR)

(73) Assignee: Nexans, Paris (FR)

( * ) Notice: Subject to any disclaimer, the term of this patent is extended or adjusted under 35 U.S.C. 154(b) by 133 days.

(21) Appl. No.: 12/383,450

(22) Filed: Mar. 24, 2009

(65) Prior Publication Data

US 2010/0087101 A1 Apr. 8, 2010

(30) Foreign Application Priority Data

Mar. 26, 2008 (FR) ..... 08 51948

(51) Int. Cl.
*H01R 4/02* (2006.01)

(52) U.S. Cl. ..... 174/88 R; 174/125.1

(58) Field of Classification Search ..... 174/88 R, 174/125.1

See application file for complete search history.

(56) References Cited

U.S. PATENT DOCUMENTS 3,895,432 A * 7/1975 Diepers et al. ..... 29/599
6,583,351 B1 6/2003 Artman
7,030,314 B2 4/2006 Ashibe et al.
7,067,739 B2 6/2006 Ashibe et al.
7,094,973 B2 8/2006 Ashibe et al.
7,279,639 B2 10/2007 Ashibe et al.

FOREIGN PATENT DOCUMENTS

| | | |
|---|---|---|
| DE | 2007015721 | 4/2008 |
| GB | 574323 | 1/1946 |
| WO | 2007060804 | 5/2007 |

OTHER PUBLICATIONS

International Search Report dated Oct. 17, 2008.
Search Report dated Mar. 20, 2009.

* cited by examiner

*Primary Examiner* — Chau N Nguyen
(74) *Attorney, Agent, or Firm* — Sofer & Haroun, LLP

(57) ABSTRACT

The invention relates to a device for connecting together two abutting superconductive cables, each cable being constituted by at least a resistive conductive central support of substantially cylindrical shape, by at least one layer of superconductive material placed around the support, and by an insulating sheath surrounding said layer of superconductive material, the end of each cable being stripped to reveal the central support and said layer of superconductive material, the device being provided with an outer covering of insulating material. According to the invention, the device comprises at least one respective conductive sleeves engaged around the stripped portion of each of the cables, together with a conductive tube containing said sleeves and connected to them.

7 Claims, 1 Drawing Sheet

DEVICE FOR CONNECTING TWO SUPERCONDUCTIVE CABLES

RELATED APPLICATION

This application claims priority to French Patent Application No. 08 51948, filed on Mar. 26, 2008, the entirety of which is incorporated by reference.

BACKGROUND

1. Field of the Invention

The present invention relates to a device for connecting two superconductive cables in abutment. The invention applies most particularly to high voltage.

2. Description of Related Art

A superconductive cable essentially comprises a central support of generally cylindrical shape having a superconductive material wound thereabout, and an insulating sheath is placed around the superconductor. The central support is constituted by a material that is electrically conductive, e.g. a cable or a tube of copper. The superconductive material may be in the form of a tape wound around the central support in one or more layers.

Patent document EP 1 841 011 describes a termination for connecting one end of a superconductive cable to a conventional cable that is not superconductive.

A device for connecting together two superconductive cables is described in patent document EP 1 489 693.

The connection device has a central conductive connection member connecting together the ends of two stripped cables that are disposed in a hollow tube of an insulating spacer made up of a resin portion and of said tube.

A device for connecting together two superconductive cables is also described in patent document EP 1 489 691.

That connection device comprises a central conductive connection member connecting together the ends of the two stripped cables and placed in an insulating element.

Such devices for connecting abutting superconductive cables do not make it easy for the connection to be taken apart and/or reassembled, without it being necessary to cut away a portion of the cable, e.g. if one of the superconductive cables is to be replaced.

OBJECT AND BRIEF SUMMARY OF THE INVENTION

The invention seeks to provide a device for connecting together two abutting superconductive cables, which device can be taken apart without acting on the cables themselves.

To solve this problem, the invention provides a device for connecting together two abutting superconductive cables, each cable being constituted by at least a resistive conductive central support of substantially cylindrical shape, by at least one layer of superconductive material placed around the support, and by an insulating sheath surrounding said layer of superconductive material, the end of each cable being stripped to reveal the central support and said layer of superconductive material, the device being provided with an outer covering of insulating material and comprising at least one respective conductive sleeve engaged around the stripped portion of each of the cables, together with a conductive tube containing said sleeves and connected to them.

After removing the outer covering of insulating material, the tube can be disconnected from the sleeves and removed, thereby separating it from the sleeves and enabling the connection device to be taken apart.

It can be assembled easily on site.

By means of the invention, it is also possible to make a connection between two cables having a conductive central support of relatively large diameter for transporting relatively high currents.

In a preferred embodiment, each of said sleeves is extended by an end portion of rounded outside shape.

Preferably, said rounded end portion presents a maximum outside diameter greater than the diameter of the sleeves and forming a radial shoulder.

Advantageously, said conductive tube is in abutment against said shoulder of the end portion of said sleeve.

Said sleeve may include at least one orifice enabling solder material to be introduced into the space situated between the layer of superconductive material and the inside wall of the sleeve.

Said sleeve may include electrical contact means in its outside surface.

Preferably, said electrical contact means are constituted by grooves of annular shape holding metal contact blades.

Advantageously, said tube is mechanically connected on said sleeve.

Said tube may be connected by screws on said sleeve.

Preferably, said sleeve and said tube are made of metal.

BRIEF DESCRIPTION OF THE DRAWINGS

The invention is described below in detail with the help of figures that merely show a preferred embodiment of the invention.

MORE DETAILED DESCRIPTION

Figure 1:
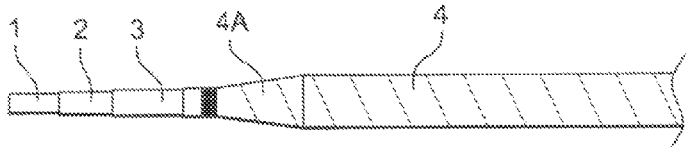
FIG. 1 is a view of the end of a first superconductive cable.

The end of the superconductive cable shown in FIG. 1 is constituted by an electrically-conductive resistive central support 1 of substantially cylindrical shape. By way of example, the support may be a cable of copper wires or a low resistivity metal tube, made of copper or of silver-plated copper, for example. Two superposed layers 2, 3 of a superconductive material surround the central support 1. An electrically insulating sheath 4 surrounds the superconductive layer 3.

The superconductive layers 2, 3 may be formed by tapes or wires of superconductive material that are wound respectively about the central support 1. In general, the cable cannot have only one superconductive layer 2 or 3. The superconductive wires or tapes may, for example, be of the $Bi_2Sr_2Ca_2Cu_3O_x$ (BSCCO) type or of the YBaCuO type.

The end of the cable is stripped in staircase manner so as to reveal in succession, going from the cable towards its end and over a length that may vary, the first superconductive layer 3, the second superconductive layer 2, and then the central support 1.

The end of the electrically-insulating sheath is shaped to be conical at its end 4A so as to form a chamfer section going from its outside diameter to an outside diameter that is slightly greater than the outside diameter of the superconductive layer 3.

Figure 2:
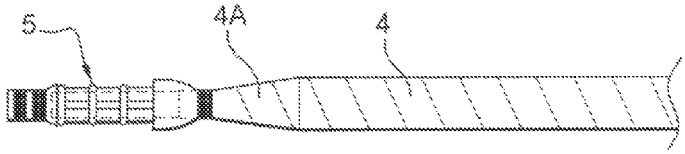
FIG. 2 shows a first step of mounting a connection device in accordance with the invention.
Figure 3:
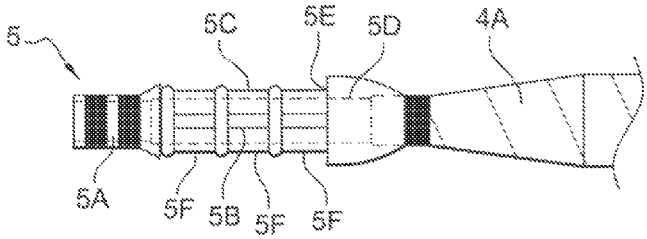
FIG. 3 is a view on a larger scale than FIG. 2.

A conductive sleeve 5 is engaged around the stripped portion of the cable, as shown in FIG. 2, and as is particularly visible in FIG. 3.

The sleeve 5 is of the type described in patent application EP 1 841 011.

The metal sleeve 5 covers the stripped central support 1 and the stripped superconductive layers 2, 3. The sleeve includes a first portion 5A and a second portion 5B. The first portion 5A is in the form of a hollow cylinder of inside diameter that is very slightly greater than the diameter of the support 1 so that the first portion 5A of the sleeve can be fastened on the support 1 merely by mutual engagement or by crimping. For example, the sleeve may be copper and, when the central support is also made of copper, this serves to obtain a good copper-on-copper electrical connection. The copper may also be silver-plated. The second portion 5B of the sleeve is substantially in the form of a hollow cylinder of length that is not less than the length of the stripped portions of the superconductive layers 2, 3 so as to cover them completely. The inside diameter of the second portion 5B of the sleeve is greater than the diameter of the superconductive layer 3 (which has a diameter greater than the diameter of the superconductive layer 2) so that a gap is left between the inside wall of the second portion 5B of the sleeve and the superconductive layers 2, 3. An orifice 5C is pierced through the second portion 5B, presenting dimensions that are large enough to enable a powder of solder material to be poured through said orifice or to enable a molten solder alloy to be cast therethrough directly, so as to take position between the inside wall of the second portion 5B of the sleeve and the superconductive layers 2, 3. By way of example, the orifice may be oblong in shape.

The solder material fills the space between the second portion 5B of the sleeve and the superconductive layers 2, 3 at least in part. This material is electrically conductive and advantageously possesses a melting temperature that is relatively low, e.g. lower than about 100° C. For example it may be an alloy of Sn—Bi—Pb composition. This avoids damaging the superconductive layers by heating them to too high a temperature, while also providing a good electrical connection between the superconductive layers and the sleeve 5.

The length of the sleeve is such that it completely covers the stripped portions 2, 3 of the superconductive layers, the stripped portion 1 of the central support, and the end of the insulating sheath 4.

The second portion 5B of the sleeve is extended by an end portion 5D of rounded outside shape presenting a maximum outside diameter greater than that of the sleeve and forming a radial shoulder 5E.

The sleeve 5 includes electrical contact means in the outside wall of its second portion 5B, said means being constituted by grooves 5F machined in the outside wall of the second portion 5B of the sleeve. These grooves are designed to receive metal contact blades or annular shape.

Figure 4:
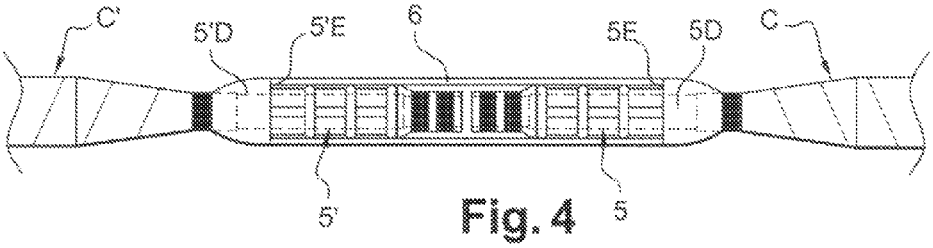
FIG. 4 is a section view of two superconductive cables provided with a connection device in accordance with the invention.
Figure 5:
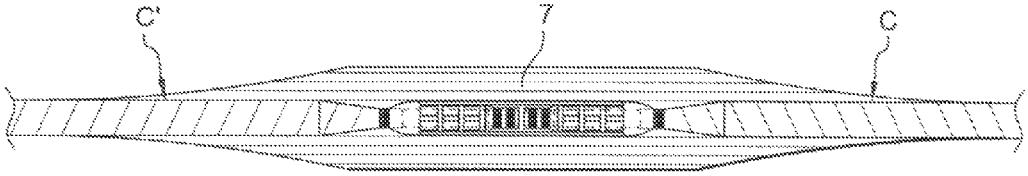
FIG. 5 is a section view of the final connection in accordance with the invention.

The invention provides a device for connecting together two such superconductive cables C, C' in abutment, and a respective metal sleeve 5, 5' as described above is fastened around the stripped end of each superconductive cable, as shown in FIG. 4.

To make the connection, once the metal contact blades have been put into place in the corresponding grooves in the sleeves, a metal conductive tube 6 containing the sleeves 5, 5' and connected thereto is placed in abutment against the shoulders 5E, 5'E of the end portion 5D, 5' of each sleeve. The tube is of inside diameter slightly greater than the outside diameter of the second portions of the sleeves, and of outside diameter substantially equal to the maximum outside diameter of the rounded end portion of each sleeve. The tube 6 is mechanically connected to the sleeves 5, 5', e.g. by set screws (not shown).

The connection is then insulated by an outer covering 7 of insulating material, advantageously being a winding of paper tapes. Because of the chamfer shape 4A at the end of the outer sheath and because of the rounded shape of the end portions 5D, 5'D of the sleeves, it is possible to make this covering without leaving any empty space that might lead to electrical breakdown. A semiconductive layer, e.g. made of carbon black paper, may be placed between the metal connection and the outer covering 7.

What is claimed is:

1. A device for connecting together two abutting superconductive cables, each cable being constituted by at least a resistive conductive central support of substantially cylindrical shape, by at least one layer of superconductive material placed around the support, and by an insulating sheath surrounding said layer of superconductive material, the end of each cable being stripped to reveal the central support and said layer of superconductive material, said device comprising:

an outer covering of insulating material; and at least two separate conductive sleeves respectively engaged around the stripped portion of each of the cables, together with a conductive tube containing said sleeves and electrically connected to them, wherein each of said sleeves is extended by an end portion of rounded outside shape.

2. A device according to claim 1, wherein said rounded end portion presents a maximum outside diameter greater than the diameter of the sleeves and forming a radial shoulder.

3. A device according to claim 2, wherein said conductive tube is in abutment against said shoulder of the end portion of said sleeve.

4. A device for connecting together two abutting superconductive cables, each cable being constituted by at least a resistive conductive central support of substantially cylindrical shape, by at least one layer of superconductive material placed around the support, and by an insulating sheath surrounding said layer of superconductive material, the end of each cable being stripped to reveal the central support and said layer of superconductive material, said device comprising:

an outer covering of insulating material; and at least two separate conductive sleeves respectively engaged around the stripped portion of each of the cables, together with a conductive tube containing said sleeves and electrically connected to them, wherein each of said sleeves includes at least one orifice enabling solder material to be introduced into the space situated between the layer of superconductive material and the inside wall of each sleeve.

5. A device according to claim 4, wherein each of said sleeves includes electrical contact means in its outside surface.

6. A device according to claim 5, wherein said electrical contact means are constituted by grooves of annular shape holding metal contact blades.

7. A device for connecting together two abutting superconductive cables, each cable being constituted by at least a resistive conductive central support of substantially cylindrical shape, by at least one layer of superconductive material placed around the support, and by an insulating sheath surrounding said layer of superconductive material, the end of each cable being stripped to reveal the central support and said layer of superconductive material, said device comprising:

an outer covering of insulating material; and at least two separate conductive sleeves respectively engaged around the stripped portion of each of the cables, together with conductive tube containing said sleeves and electrically connected to them, wherein said tube is mechanically connected on said sleeves by screws on said sleeve.

* * * * *